United States Patent [19]

Scott

[11] 4,259,116

[45] Mar. 31, 1981

[54] METHOD FOR FORMING SILVER PRECIPITATING NUCLEI

[75] Inventor: Kenneth G. Scott, Sherborn, Mass.

[73] Assignee: Polaroid Corporation, Cambridge, Mass.

[21] Appl. No.: 108,456

[22] Filed: Dec. 31, 1979

[51] Int. Cl.[3] ..... C23C 3/02

[52] U.S. Cl. ..... 106/1.28; 106/135; 106/137; 106/1.05; 252/313 R; 430/247

[58] Field of Search ..... 106/1.05, 1.28, 135, 106/137; 252/313 R; 430/247

[56] References Cited

U.S. PATENT DOCUMENTS

| | | | |
|---|---|---|---|
| 2,698,236 | 12/1954 | Land | 95/8 |
| 2,726,154 | 12/1955 | Land | 430/228 |
| 2,857,274 | 10/1958 | Land et al. | 430/251 |
| 2,861,885 | 11/1958 | Land | 430/229 |
| 2,944,894 | 7/1960 | Land | 96/3 |
| 3,019,124 | 1/1962 | Rogers | 430/207 |
| 3,032,008 | 5/1962 | Land et al. | 425/382 |
| 3,284,208 | 11/1966 | Land | 430/7 |
| 3,536,488 | 10/1970 | Land | 96/24 |
| 3,615,426 | 10/1971 | Debruyn | 430/234 |
| 3,615,427 | 10/1971 | Debruyn | 430/234 |
| 3,615,428 | 10/1971 | Weed | 430/235 |
| 3,615,429 | 10/1971 | Weed | 430/234 |
| 3,615,440 | 10/1971 | Bloom | 430/234 |
| 3,647,440 | 3/1972 | Rasch | 96/29 |
| 3,730,716 | 5/1973 | Land et al. | 430/228 |
| 3,894,871 | 7/1975 | Land | 430/228 |

OTHER PUBLICATIONS

Land, "One Step Photography", *Photographic Journal*, pp. 7–15, Jan. 1950.

*Primary Examiner*—Lorenzo B. Hayes
*Attorney, Agent, or Firm*—Philip G. Kiely

[57] ABSTRACT

Noble metal silver precipitating nuclei are prepared by reducing a noble metal salt or complex in the presence of a polymer with a $Cr^{+3}/Sn^{\circ}$ complex. The invention is also directed to film units employing said nuclei.

10 Claims, 2 Drawing Figures

METHOD FOR FORMING SILVER PRECIPITATING NUCLEI

BACKGROUND OF THE INVENTION

Procedures for preparing photographic images in silver by diffusion transfer principles are well known to the art. Thus, a silver diffusion transfer reversal process may provide a positive silver transfer image by development of the latent image provided by exposure of a photosensitive silver halide emulsion and, substantially contemporaneous with such development, a soluble silver complex is obtained, by reaction of a silver halide solvent with unexposed and undeveloped silver halide of the emulsion. The resultant soluble silver complex is, at least in part, transported in the direction of a suitable print-receiving element and the silver of the complex there precipitated to provide the requisite positive silver image formation.

The silver receptive stratum employed may be so constituted as to provide an unusually effective silver precipitating environment which causes the silver deposited therein, in comparison with negative silver developed in the silver halide emulsion, to possess an extraordinarily high covering power, that is, opacity per given mass of reduced silver; see Edwin H. Land, One Step Photography, Photographic Journal, section A, pp. 7–15, January 1950.

Specifically, to provide such environment, silver precipitation nuclei may be disposed within the silver receptive stratum in clusters possessing a diameter directly proportional to the mass of image silver to be deposited in situ by reduction. Such conformation can be employed to cause image silver to precipitate, in association with the silver precipitation nuclei clusters, with the required density and of a size directly related to the physical parameters of the clusters. The image silver thus precipitated in situ in galaxies of chosen physical parameters provides image conformation in which the elemental silver of the print-receiving element may possess a very high order of covering power, for example, five to fifteen or more times that of the negative elemental image silver in the silver halide element.

Additive color reproduction may be produced by exposing a photosensitive silver halide emulsion through an additive color screen having filter media or screen elements each of an individual additive color, such as red, or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

U.S. Pat. No. 3,536,488 is directed to photosensitive silver halide crystals or grains dispersed in an environment containing silver precipitating nuclei or agents which in the presence of a solvent developer composition cause exposed grains to be reduced to opaque structures smaller in presented area than the area of the same grains developed in an identical developer composition absent such precipitating nuclei. Silver image masses derived from exposed silver halide grains developed in accordance with U.S. Pat. No. 3,536,488, accordingly, possess low optical covering power as compared with the covering power provided by identical grains developed in the same solvent developer absent the presence of the precipitating environment. Specifically, the patent provides for the production of a direct positive silver image in which the mass distribution of silver is substantially uniform macroscopically and nonuniform microscopically, and in which the transmissiveness of silver image mass is a function of the quantity of actinic radiation which exposed the photosensitive silver halide. The exposed silver halide grains are reduced, in situ, as compact masses possessing low covering power simultaneously with reduction, in situ, of unexposed silver halide grains as a colloidal dispersion possessing high covering power. The direct positive silver image thus produced in situ possesses extraordinary high sharpness when compared with transfer processes in which unexposed silver halide grains are dissolved and transferred to the ultimate image-carrying site. U.S. Pat. No. 3,536,488 is incorporated by reference herein in its entirety.

As set forth in U.S. Pat. No. 2,698,236 the array of silver atoms precipitated in the image-receiving element is influenced by the size of the silver-precipitating nuclei. If the silver precipitating nuclei are relatively small, the silver deposited thereon will be of a corresponding size and, therefore, generally red in color which is undesirable. Clusters or galaxies of silver precipitating nuclei possessing a diameter directly proportional to the mass of individual silver particles to be precipitated therein are disposed in the image-receiving layer to cause silver to precipitate in association with silver precipitating nuclei clusters with a required density and of a size directly related to the physical parameters of the clusters, thus providing the desired black silver image.

It has also been found that silver precipitating nuclei disposed in a relatively thick layer, i.e., 1 micron or greater, also results in a redder image. While theories can be advanced for this phenomenon, the precise reason is not known.

Noble metal silver precipitating nuclei are known to the art. Copending application Ser. No. 69,282 filed Aug. 24, 1979 (common assignee) discloses a method of forming such nuclei by the reduction of a noble metal salt or complex. U.S. Pat. No. 3,647,440 also discloses noble metal silver precipitating nuclei obtained by reducing a metal salt in the presence of a protective colloid with a reducing agent having a standard potential more negative than −0.30.

Copending application Ser. No. 897,944, filed Apr. 4, 1978, (common assignee), now U.S. Pat. No. 4,209,330, is directed to a method of forming clusters of noble metal silver precipitating nuclei. Noble metal nuclei formed by the reduction of noble metal salts or complexes in colloidal suspension are formed into clusters by causing an instability in the colloid, e.g., by adjusting the pH of the colloid solution to at least about 2.6. If desired, the clusters may be employed at this point either by suitable separation techniques or by the addition of a bulking polymer to the colloid to impart stability to the clusters. If a separation technique is employed, the clusters may be allowed to floc, whereupon separation of the floc may be carried out by filtering and the like, and then redispersing the flocced particles in a suitable polymer binder with, preferably, sonification, and coating the thus-formed polymer/cluster mixture which may be coated on a support to provide an image-receiving element.

Such a method presents scale-up problems, and, in addition, the nuclei so produced must be used relatively soon after preparation to insure sensitometric uniformity in a product employing the nuclei.

A novel method for producing noble metal silver precipitating nuclei has now been found, which nuclei are particularly suited for use in the same layer as the photosensitive silver halide grains.

SUMMARY OF THE INVENTION

The present invention is directed to a method for forming noble metal silver precipitating nuclei in the presence of a polymer by reducing a noble metal salt or complex with a $Cr^{+3}/Sn^{\circ}$ complex. The invention is also directed to film units employing said nuclei.

DETAILED DESCRIPTION OF THE INVENTION

Figure 1:
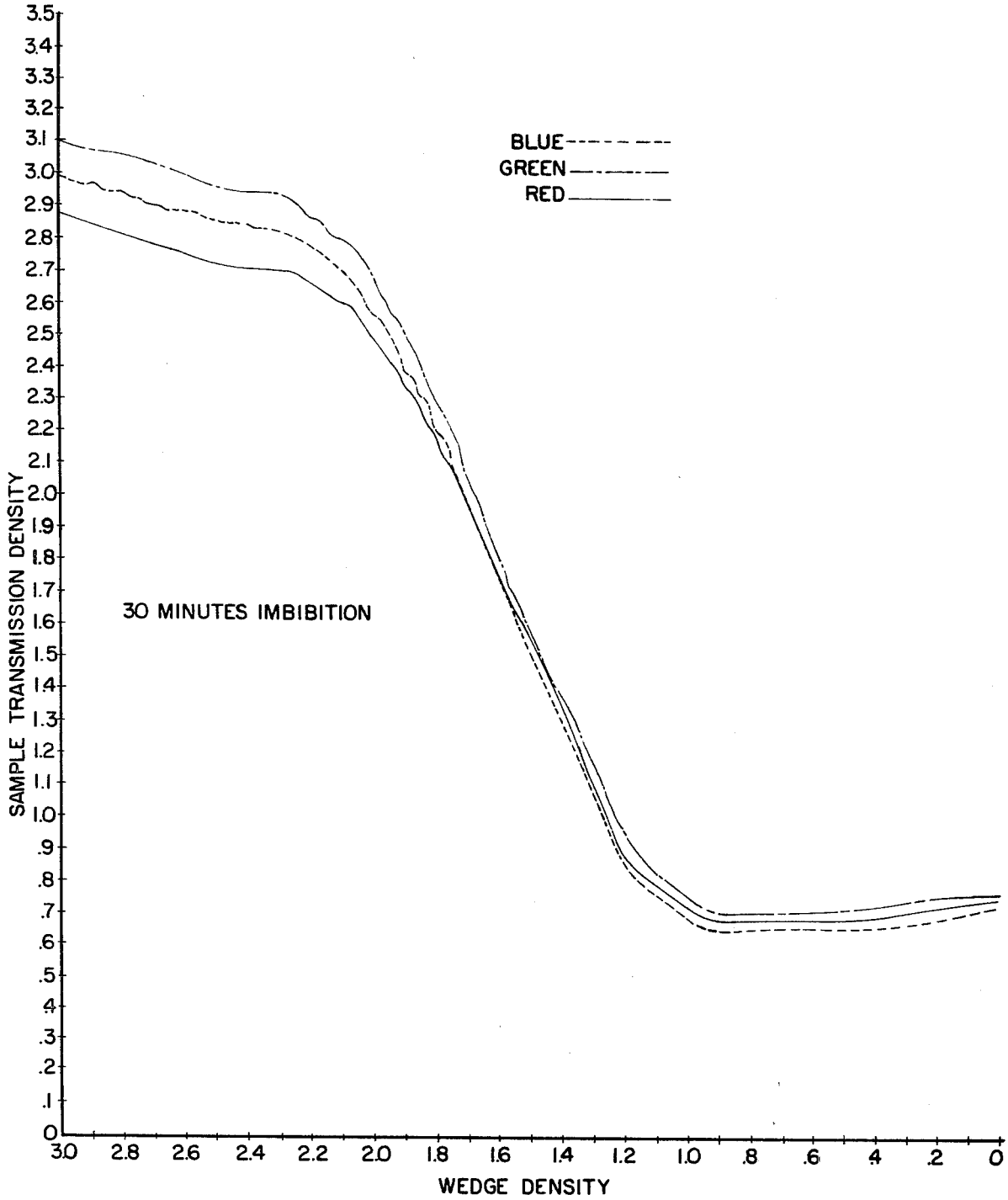
FIGS. 1 and 2 are characteristic curves of the film units of the present invention.

As stated above, a problem often encountered in the formation of noble metal silver precipitating nuclei involves the particle size of the nuclei formed as a result of the reduction of the noble metal salt or complex. For ease of manufacturing and uniformity of the product, it is preferred to form nuclei of the desired size during the reduction step without an additional operation to form the desired clusters.

The novel method of the present invention involves the reduction of noble metal salts or complexes by a chromic-tin complex. While the exact nature of the complex is not known it is believed that the tin is in the form of a solution of a water-soluble complex rather than a colloid or suspension. Thus, the terms "$Cr^{+3}/Sn^{\circ}$ complex" and "chromic-tin complex" used herein are intended to refer to the reaction product of a chromic salt and tin dust in an aqueous medium with at least a starting 4/1 mole ratio of chromic ion to $Sn^{\circ}$. While Mossbäuer Spectroscopy cannot fully characterize the chemical composition of the $Cr^{+3}/Sn^{\circ}$ complex, it has produced evidence that the environment surrounding the tin indicates that it is in the +2 oxidation state.

Subsequent to reduction of the noble metal salt or complex to provide the noble metal nuclei, the chromic ion in the nuclei fluid is removed by chemical means to avoid any problems that may result in the subsequent utilization of the nuclei in systems containing gelatin, since chromic ion may lead to undesirable cross-linking of the gelatin.

In a particularly preferred embodiment, a formate reducing agent, such as sodium formate, is used as an additional reducing agent in combination with the $Cr^{+3}/Sn^{\circ}$ complex reducing agent.

In an alternative embodiment, subsequent to the addition of the noble metal compound, an alkali metal acetate, preferably sodium acetate, may be added to the reaction mix. The acetate appears to perform a dual function when a formate is employed; it raises the pH of the reaction mix, thereby accelerating formate reduction of $Pd^{+2}$ and possibly $Sn^{+2}$ formed during the reaction. If acetate is not employed, excess $Pd^{+2}$ is found to be present at the end of the reaction. The acetate also aids in the removal of the chromic ion from the nuclei mix by assisting in the complexation of $Cr^{+3}$ with 2,4-pentandione.

By means of the present invention, nuclei clusters of about 10–50 nm are formed as a relatively stable colloid. Nuclei formed by the procedure of the present invention are particularly suitable for use in film units wherein nuclei are disposed in the same layer as the photosensitive silver halide grains as well as in receiving layers which do not include silver halide grains.

The noble metals employed in the present invention include gold, palladium and platinum. Particularly superior results are achieved with palladium. For convenience, the invention will be described primarily in terms of this preferred embodiment.

Combinations of noble metals may be used as well as single noble metals. In a preferred embodiment, noble metal salts or complexes may be reacted with the above-described complex reducing agent to provide the desired noble metal nuclei. Suitable compounds include the following:

$K_2PdCl_4$
$PdCl_2$
$H_2PtI_6$
$AgNO_3$
$HAuCl_4$

The purpose of the polymer during nuclei preparation is to maintain the noble metal nuclei as a colloid and sufficient polymer is employed to prevent precipitation of the nuclei. Such polymers employed in nuclei preparation are known to the art.

The silver precipitating layer employing the nuclei of the present invention may contain other polymers in addition to the one employed in nuclei formation. Such polymers are known to the art and include hydroxyethyl cellulose and polyvinyl hydrogen phthalate.

EXAMPLE A $Cr^{+3}/Sn^{\circ}$ Complex Preparation 216.3 g of water were brought to 40° C. and maintained at that temperature. 35.4 g of chromium chloride hexahydrate were added with vigorous stirring. A dark green solution resulted. 22.5 g of acetic acid were added followed by 3.94 g of tin dust. Initially the $Sn^{\circ}$ formed a grey suspension in the green solution which slowly gave way to a clear dark purple solution which appeared by transmitted light (Tungsten) as dark ruby red. The solution was left at least 4 hours at 40° C. to assure completion of the reaction.

EXAMPLE B

Nuclei Formation 684.62 g of distilled water were brought to 95° C. with stirring in a non-metal container and maintained at that temperature. To the water was then added in the following order:

22.5 g of gelatin (10%, added as chilled cubes)
3.78 g of sodium formate
139.1 g of the $Cr^{+3}/Sn^{\circ}$ complex solution prepared in Example A
50 g of palladous chloride solution (8.51% $PdCl_2$ and 2.15% HCl).

After the addition of each material, the temperature was brought back to 95° C. Subsequent to the addition of the palladous chloride, the mix forms a dark brown colloid. After 15 minutes at 95° C., the following materials were added in order to provide for the additional reduction at a higher pH and also for removal of the chromic ion; 50 g of 2,4-pentanedione and 20 g of anhydrous sodium acetate. After the addition of the sodium acetate was completed a sudden further darkening of the solution occured with a vigorous evolution of carbon dioxide. The temperature was maintained at about 91°-92° C. for about 5 minutes. After 20 minutes from the addition of the palladous chloride, 600 g of 0.25% gelatin solution at 40° C. were added. The mix was then further cooled to at least 30° C. and stored for at least 12 hours during which time chromium triacetylacetonate slowly crystallizes. The thus-formed chromium triacetylacetonate crystals were removed by decanting the solution through a silk screen followed by suction filtration through a Whatman #4 filter paper. The filtrate was then dialyzed through a Dow Model #5 Artificial Kidney to a final pH of about 4.3 to 4.8 and a conductivity of about 100 $\mu$mhos/cm$^2$.1500 g of dialyzed nuclei fluid at room temperature were then immediately combined with 397.5 g of melted 24% gelatin. The mixture was then stirred and heated to about 50° C. until homogeneous. The nuclei could be used immediately or stored under refrigeration for future use.

In an alternative embodiment the 2,4-pentanedione, sodium acetate and gelatin were combined into one solution for ease of addition. The ingredients were separately dissolved at 40° C. and added together to the reaction mixture 15 min. after the palladous chloride solution, whereupon the temperature dropped from 95° to 75° C. The mix was then held at 75° C. for 10 min. before cooling to 30° C. Chromium removal and the remainder of the steps set forth above followed.

EXAMPLE 1

A film unit was prepared comprising a transparent polyester film base carrying on one surface an additive color screen of approximately 1500 triplets per inch of red, blue and green filter screen elements in repetitive side by side relationship; 328 mgs/ft$^2$ of polyvinylidene chloride protective overcoat layer; an emulsion/silver-precipitating layer prepared in the following manner;

The following ingredients were combined in order as listed at 40° C.

59.28 g, 5% propylene glycol alginate 162.1 g nuclei mix prepared from the procedure of Example B 99.5 g distilled water 35.08 g of 24% gelatin 50.6 g of 25% carboxylated styrene/butadine copolymer latex (Dow-620, Dow Chemical Company, Midland, Mich.)

The thus-formed premix was then filtered through a 10$\mu$ Cox filter under nitrogen pressure and 343.6 g of the filtered premix was combined with 234 g of a panchromatically sensitized silver iodobromide emulsion having a grain size of about 0.72$\mu$ with a 0.827 gel to silver ratio. The thus-formed emulsion mix was coated over the above-identified protective overcoat layer at a coverage of 150 mgs/ft$^2$ of silver and 1.31 mgs/ft$^2$ of nuclei. Panchromatic sensitization was provided with 5,5'-dimethyl-9-ethyl-3,3'-bis-(3-sulfopropyl)thiacarbocyanine-triethyl-ammonium salt (0.53 mg/g Ag); 5,5'-diphenyl-9-ethyl-3,3-bis-(4-sulfobutyl)oxacarbocyanine (1.0 mg/g Ag); anhydro 5,6-dichloro-1,3-diethyl-3'-(4''-sulfobutyl)-benzimidazolothiacarbocyanine hydroxide (1.0 mg/g Ag); and 3-(3-sulfopropyl)-3'-ethyl-4,5-benzothia-thiacyanine betaine (1.25 mg/g Ag); red, green, green and blue sensitizers respectively.

The following top coat was provided over the emulsion layer.

| Top Coat | mgs/ft$^2$ |
|---|---|
| Gelatin | 341 |
| Dow 620 (carboxylated styrene/butadiene copolymer latex Dow Chemical Co., Midland, Michigan) | 175 |
| Propylene glycol alginate | 25.7 |
| Dioctyl ester of sodium sulfosuccinate | 1.2 |
| $Au^{+1}$ complex of methylthioglycolate | 10 (as gold) |
| Pyridinium bis-1,5 (1,3-diethyl-2-thiol-5-barbituric acid) pentamethine oxanol (silver complex) | 5.6 |

A second film unit was prepared as above except that the nuclei preparation did not include sodium formate.

The film units prepared according to the above procedure were given a 16 mcs exposure with a Xenon sensitometer and processed with mechanical rollers at a 0.0012 in. gap disposing the below indicated processing composition between the top coat and a polyethylene terephthalate cover sheet.

| Processing Composition | Weight % |
|---|---|
| Sodium hydroxide | 8.4 |
| Hydroxyethyl cellulose (sold by Hercules, Inc., Wilmington, Delaware under the tradename Natrosol 250 HH) | 0.6 |
| Tetramethyl reductic acid | 7.0 |
| Potassium bromide | 0.6 |
| Sodium Sulfite | 0.8 |
| 2-methylthiomethyl-4,6-dihydroxypyrimidine | 7.0 |
| 4-aminopyrazolo-[3,4d]-pyrimidine | 0.02 |
| N-benzyl-2-methylpyridinium bromide (50% solution) | 3.5 |
| Water | 66.6 |
| $Na_2B_4O_7 \cdot 10H_2O$ | 3.3 |
| Glycerine | 1.7 |
| p-isononyl phenoxy poly glycidol (containing about 10 glycidol units) | 0.5 |

The film units were then held in the dark for 30 minutes and the cover sheets were then removed, retaining the rest of the film unit together, and air drying. The spectral data shown in the attached Figures were obtained by reading the neutral column to red, green and blue light in an automatically recording densitometer.

Figure 2:
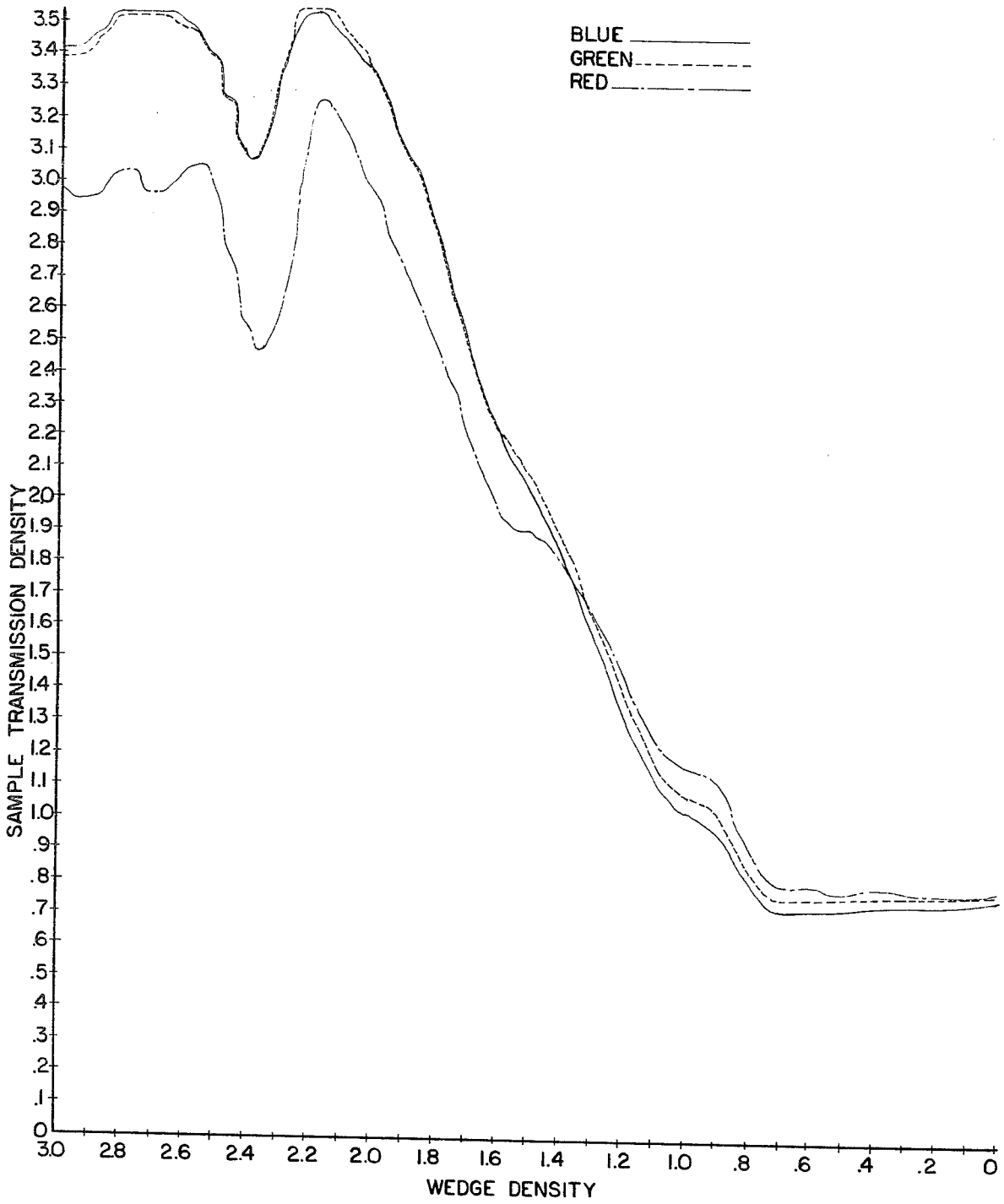

FIG. 1 shows that a fairly neutral tone was obtained using the nuclei prepared according to the present invention, as well as good speed and good dynamic range. FIG. 2, data generated from the film unit wherein the nuclei were prepared in the absence of formate, showed, in comparison with Example 1, higher $D_{max}$ and a redder tone with a slower speed.

It should be noted that no significant speed loss is observed by disposing the nuclei of this invention in the emulsion as compared to nuclei prepared by prior art methods.

While the invention was described previously in terms of an additive color system, it should be understood that the noble metal nuclei prepared according to the procedure of the present invention are also suitable for use in black and white silver diffusion transfer systems.

The support employed in the present invention is not critical. The support or the film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelength ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example, may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1958 to Edwin H. Land or pseudouracils, such as the 4,6-dihydroxy-pyrimidines. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition, by materials such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, tolu-hydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha$-$\beta$-enediols as disclosed in U.S. Pat. No. 3,730,716 issued to Edwin H. Land, Stanley M. Bloom and Leonard C. Farney on May 1, 1973.

What is claimed is:

1. A method for forming noble metal silver precipitating nuclei which comprises reducing a noble metal salt or complex in the presence of a polymer with a trivalent chromium ion/metallic tin complex produced by reacting a chromic salt with metallic tin in aqueous medium.

2. The method of claim 1 wherein said reduction is carried out in an aqueous solution.

3. The method of claim 1 wherein said polymer is gelatin.

4. The method of claim 1 further including a formate salt as an additional reducing agent.

5. The method of claim 4 wherein said formate is sodium formate.

6. The method of claim 1 wherein said trivalent chromium metallic tin complex is formed from chromium chloride hexahydrate.

7. The method of claim 1 wherein said noble metal is palladium.

8. The method of claim 1 further including the step of separating the excess chromic ions from the noble metal silver-precipitating nuclei.

9. The method of claim 8 wherein the chromic ions are separated as chromium triacetylacetonate subsequent to said reduction.

10. The method of claim 1 which includes the further step of dialyzing subsequent to said reduction.

* * * * *